US007448894B2

(12) United States Patent
Tsuji et al.

(10) Patent No.: US 7,448,894 B2
(45) Date of Patent: Nov. 11, 2008

(54) WATERPROOF CONNECTOR

(75) Inventors: Takeshi Tsuji, Yokkaichi (JP); Michiaki Okamoto, Yokkaichi (JP); Hiroki Hirai, Yokkaichi (JP); Chikahiro Yoshioka, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/667,063

(22) PCT Filed: Nov. 16, 2005

(86) PCT No.: PCT/JP2005/021005

§ 371 (c)(1),
(2), (4) Date: May 4, 2007

(87) PCT Pub. No.: WO2006/054575

PCT Pub. Date: May 26, 2006

(65) Prior Publication Data

US 2008/0139029 A1 Jun. 12, 2008

(30) Foreign Application Priority Data

Nov. 17, 2004 (JP) ..... 2004-333549

(51) Int. Cl.
*H01R 13/52* (2006.01)

(52) U.S. Cl. ..... 439/271; 439/278; 439/587

(58) Field of Classification Search ..... 439/271, 439/278, 587, 589, 655

See application file for complete search history.

(56) References Cited

U.S. PATENT DOCUMENTS

| | | | | |
|---|---|---|---|---|
| 5,454,737 | A * | 10/1995 | Saba | 439/655 |
| 6,364,692 | B1 | 4/2002 | Okayasu et al. | |
| 6,402,538 | B2 * | 6/2002 | Suzuki | 439/271 |
| 6,910,905 | B2 * | 6/2005 | Tanaka et al. | 439/271 |
| 2003/0190830 | A1 * | 10/2003 | Tanaka et al. | 439/271 |

FOREIGN PATENT DOCUMENTS

| | | |
|---|---|---|
| JP | A 2000-348813 | 12/2000 |
| JP | A 2003-123895 | 4/2003 |
| JP | A 2003-297479 | 10/2003 |
| JP | A 2004-172034 | 6/2004 |

* cited by examiner

*Primary Examiner*—Tho D Ta
(74) *Attorney, Agent, or Firm*—Oliff & Berridge, PLC

(57) ABSTRACT

A object of the present invention is to enable a double-locking of female terminals without making a whole connector larger in size or complicating a structure thereof while maintaining fine waterproof function. A female connector C1 includes a female housing 12 for retaining a female terminal 10 and a seal member holder 16. The seal member holder 16 retains a seal member 14 having through holes 14*a*. When the seal member holder 16 is completely attached to the female housing 12, the seal member 14 comes in close contact with a front surface of the female housing 12. In this state, a male terminal 20 of a male connector C2 fits into the female terminal 10 so that a projecting portion 25 of the connector C1 comes in close contact with an inner surface of the through hole 14*a* to make terminals waterproof individually. Further, the seal member holder 16 is provided with a double-locking piece 16*f* in, which pursues the double locking of the female terminal 10 in the female housing 12 at the time of the complete attachment.

6 Claims, 9 Drawing Sheets

WATERPROOF CONNECTOR

TECHNICAL FIELD

The present invention relates to a waterproof connector having a function to waterproof each terminal individually.

BACKGROUND ART

It is generally recognized that a conventional waterproof connector is provided with a seal member surrounding a plurality of terminal accommodating chambers and collectively waterproofs the entire terminal accommodating chambers with the seal member. However, such configuration requires a space for mounting the seal member to be secured on further exterior side from each terminal accommodating chamber, and this causes a disadvantage that a size of the whole connector becomes larger in a direction perpendicular to an axial direction of the connector. Therefore, to make the size of the connector be small, a waterproof connector having an individual waterproof function as described in the below-listed patent document 1 has been under development.

As shown in FIG. 9, the waterproof connector includes a female connector C1 in which a plurality of female terminals 110 are retained by a female housing 112, and a male connector C2 in which male terminals 120 to be inserted respectively to the female terminals 110 are retained by a rear section 122.

The female housing 112 of the female connector C1 includes terminal accommodating chambers 112*c* for accommodating the female terminals 110 respectively, and lances 113 for locking the female terminals 110 respectively in the terminal accommodating chambers 112*c*. Further, the female housing 112 has a housing front wall 112*a* formed with male terminal insertion holes 112*b* into which the male terminals 120 to fit into the female terminals 110 respectively are insertable from the front side. Further, a seal member 114 made of an elastic member such as rubber has close contact with the housing front wall 112*a*, and a seal member holder 116 is attached to a front end portion of the female housing 112 so as to cover the seal member 114 from the front side. The seal member 114 is formed with through holes 114*a* aligned respectively with the terminal insertion holes 112*b*. Similarly, a front wall of the seal member holder 116 is formed with projection through holes 116*a* aligned respectively with the through holes 114*a*.

On the rear side of each female terminal 110, a seal member 118 comes in close contact with an electric wire W onto which the female terminal 110 is crimped, to accomplish waterproofing.

On the other hand, the male connector C2 is a connector mountable onto a substrate in the drawing example. Each male terminal 120 in the male connector C2 has a pin-like shape. The male terminal 120 has one end portion as a mounting portion 120*a* to be mounted on a substrate P, and the other end as an electric connection portion 120*b* to fit into a corresponding female terminal 110. The rear section 122 integrally includes a main body wall 123 for retaining the middle portion of the male terminal 120, and a hood 124 covering the end portion of the male terminal 120 as the electric connection portion 120*b* projecting from the main body wall 123. The female housing 112 and the seal member holder 116 to be mounted thereto are insertable to the hood 124. Further, in the hood 124, there are formed projecting portions 125 projecting from a front surface 123*a* of the main body wall 123 for respective male terminals 120. Each projecting portion 125 has a shape to surround a predetermined portion of the respective male terminal 120, and has an external diameter such that the projecting portion 125 can be inserted into the projection through hole 116*a* of the seal member holder 116 and come in close contact with an inner surface of each of the through hole 114*a* of the seal member 114.

In such waterproof connector, when the electric connection portion 120*a* of each of the male terminals 120 is inserted to the female terminal 110 through the male terminal insertion hole 112*b*, each projecting portion 125 of the rear section 122 is press-inserted into each of the through holes 114*a* of the seal member 114 through each of the projection through hole 116*a* of the seal member holder 116 and comes in close contact with an inner surface of the through hole 114*a* thus making each of the terminals 110, 120 waterproof individually.

Patent Document: Japanese Unexamined Patent Publication No. 2003-297479.

DISCLOSURE OF THE INVENTION

The male connector C2 of the waterproof connector described in the Patent Document 1 is a substrate-mountable connector, and its pin-like male terminals 120 are integrally molded (in other words, insert molding) with the male housing 122. Accordingly, a waterproof function is secured for side of the male connector C2, too.

However, when the male connector C2 is configured as an electric wire connector provided at the end of an electric wire D like the female connector C1, in other words, configured as so called wire-to-wire connector for connecting wires, the male housing of the male connector C2 cannot be molded with the male terminal integrally. The male housing and the male terminal fixed on an end of an electric wire cannot choose but be molded separately, and the male housing must be formed with a terminal accommodating chamber for accommodating the male terminal and a terminal locking portion (such as a lance) for locking the male terminal in the terminal accommodating chamber. Such molding requires forming a large opening in front surface of the male housing for each male terminal in order to pull out the male housing from a die, which makes it difficult to form the male housing with the projecting portion 125 which comes in close contact with an inner surface of the through hole 114*a* of the seal member 114 as described above.

In view of the above-described circumstance, a technical object of the present invention is to enable an electric connection between wires by using a waterproof female connector, while maintaining the waterproof function of the waterproof female connector which makes each terminal waterproof individually.

As means for attaining the object, the present invention includes a waterproof male connector which is to be connected with a waterproof female connector, the female connector being provided with a plurality of female terminals held by a female housing and a female seal member provided in front of the female terminals and formed with through-holes respectively corresponding to the female terminals. The waterproof male connector comprises: a plurality of male terminals each fastened to an end of an electric wire and having an electric connection portion operable to fit into a corresponding female terminal; a male housing including terminal accommodating chambers for individually accommodating the respective male terminals and terminal locking portions for locking the male terminals in the respective terminal accommodating chambers, and holding the male terminals so that the respective electric connection portions of the male terminals project forward. The male housing includes on a front thereof projecting portions each having a shape operable to cover a rear part of the electric connection portion and to come into close contact with an inner surface of the through-hole of the seal member when the electric connection portion is placed in the male terminal to thereby prevent immersion of water into the female housing. The male housing is divided into a front section including the projecting portions and a rear section including the terminal accommodating chambers and the terminal locking portions, the front section and the rear section being combined in a state of holding a male seal member having male terminal insertion holes for passing the male terminals respectively against each other.

According to the configuration, since the male housing is divided into a front section having the projecting portions, and a rear section having the terminal accommodating chambers and the terminal locking portions, the projecting portions, the terminal accommodating chambers and the terminal locking portions can be respectively formed with no difficulties. Further, since the both sections are combined while holding a male seal member between, the male connector also can retain an individual waterproofing effect by close contact between the projecting portions and the female seal member of the waterproof female connector even though the male housing is divided.

Further, as another means for attaining the above-described object, the present invention includes a relay connector for connecting waterproof female connectors each including a plurality of female terminals, a female housing for the female terminals, and a female seal member having through holes corresponding to the female terminals in front of the female terminals. The relay connector comprises: a plurality of relay terminals each having opposite ends formed as male electric connection portions operable to fit into the respective female terminals of the respective female connectors; an insulating housing having a main body wall holding an intermediate portion of each relay terminal tightly; and projections projecting from the opposite surfaces of the main body wall, each projection covering a part of the male terminal behind the electric connection portion and being operable to come into close contact with the inner surface of the through holes of the female seal member when the electric connection portion is placed in the female terminal to thereby prevent immersion of water into the female housing.

Furthermore, the present invention includes a waterproof connector comprising: the waterproof relay connector; and a pair of waterproof female connectors being connected with each other by the waterproof relay connector. Each waterproof female connector includes: the plurality of female terminals into which the electric connection portions of the respective relay terminals can fit respectively; the female housing holding the female terminals and formed, in front of the respective female terminals, with male terminal insertion holes for passing the male terminals to fit into the female terminals; and the female seal member being in close contact with the front surface of the female housing and having through holes formed at positions corresponding to the respective male terminal insertion holes, the inner surface of each through hole coming into close contact with the outer peripheral surface of each projection of the waterproof relay connector to thereby prevent immersion of water from the male terminal insertion hole into the female housing.

According to the above-described configurations, inserting opposite electric connection portion at the end of each relay terminal into the electric connection portion of the female terminal in each female connector can make electrical connection between the female terminals of the female connectors via the relay terminals. Further, each close contact of the projecting portion of the insulating housing retaining the relay connector with an inner surface of the through hole of the female seal member in each female connector enables the female connector to perform sufficient waterproofing function.

BEST MODE EMBODIMENT FOR CARRYING OUT THE INVENTION

Figure 1:
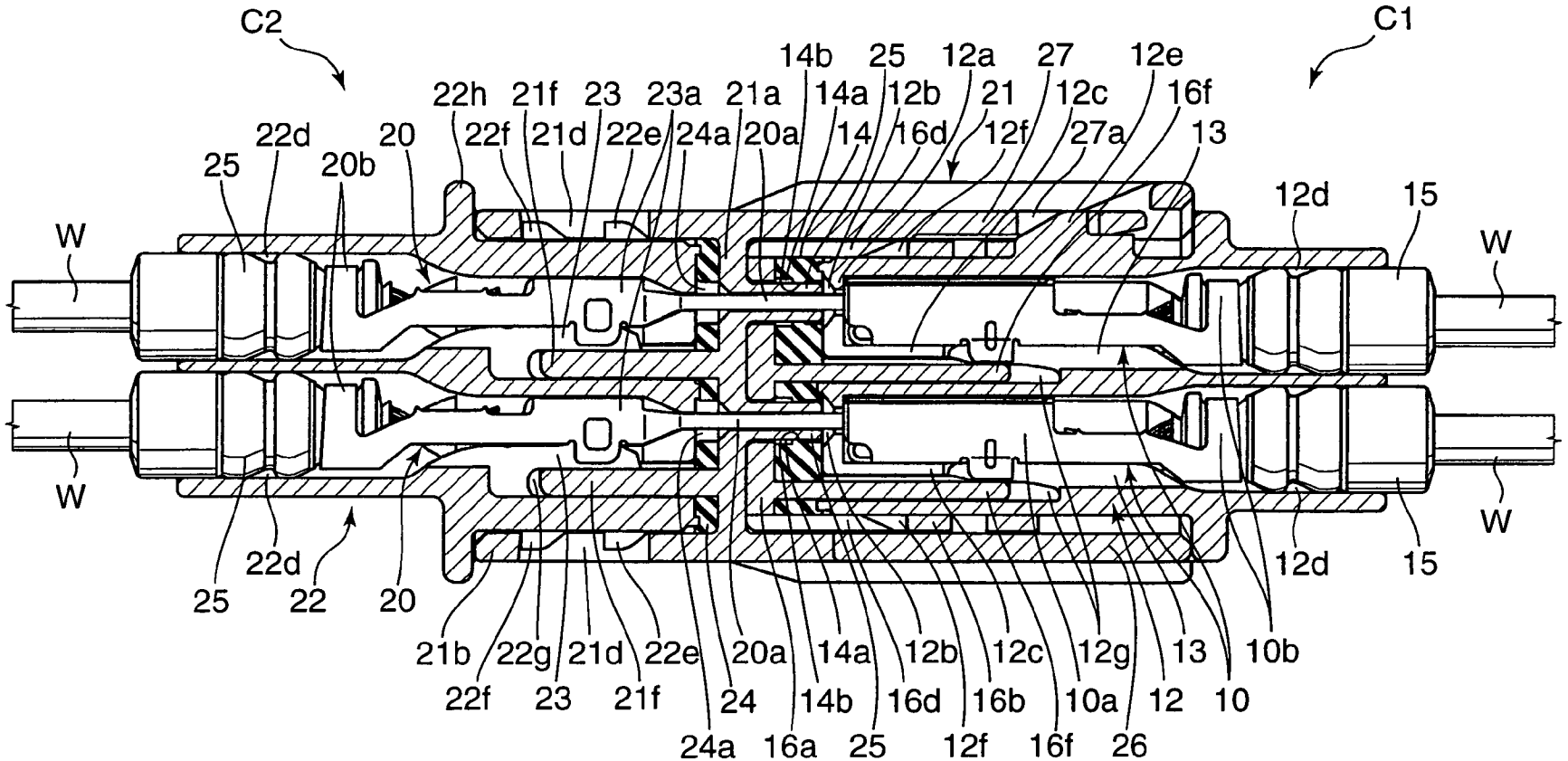
FIG. 1 is a side sectional view showing a connection state of a waterproof connector according to an embodiment of the present invention.

An embodiment of the present invention will be described with reference to FIGS. 1 to 7.

The waterproof connector shown in FIG. 1 includes a waterproof female connector C1 (hereinafter, simply referred to as "female connector C1") in which a plurality of female terminals 10 are retained by a female housing 12, and a waterproof male connector C2 (hereinafter, simply referred to as "waterproof male connector C2") in which male terminals 20 to fit into the respective female terminals 10 are retained by the male housings 21, 22. Specific configurations and assembling procedures for the connectors C1, C2 are as follows.

1) Specific Configuration of the Female Connector C1

Each female terminal 10 of the female connector C1 integrally includes a female type electric connection portion 10*a* and a barrel portion 10*b* formed on the rear side. The barrel portion 10*b* is bent to be crimped onto an end of an electric wire W. Further, on the immediate rear side from the female terminal 10, a rubber stopper 15 for waterproofing is mounted.

Figure 2B:
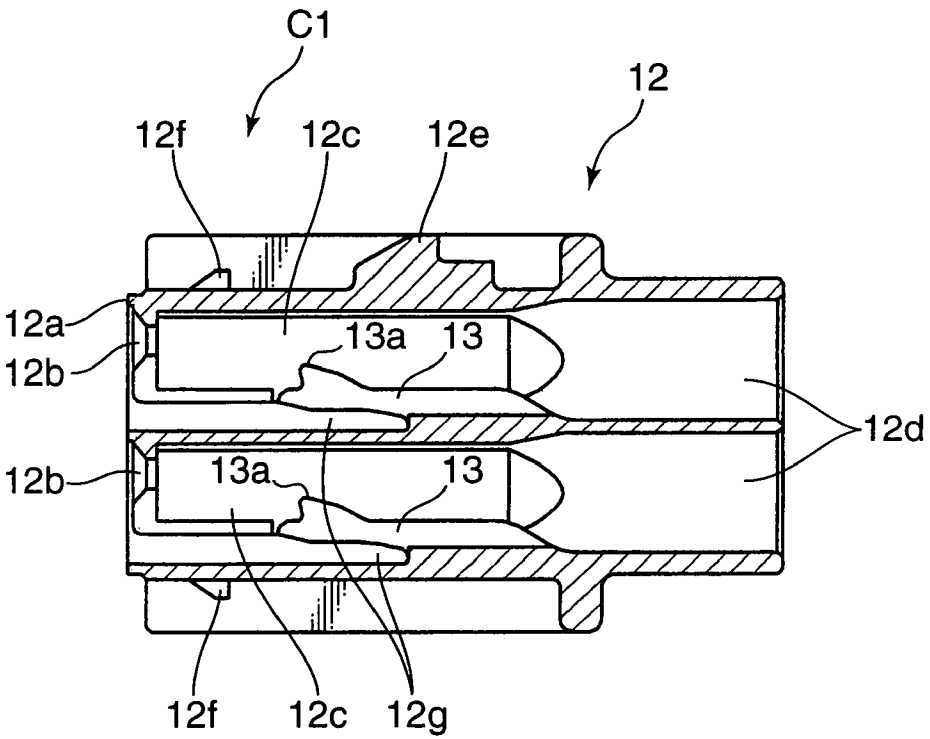
FIG. 2B is a side sectional view of the same.
Figure 2A:
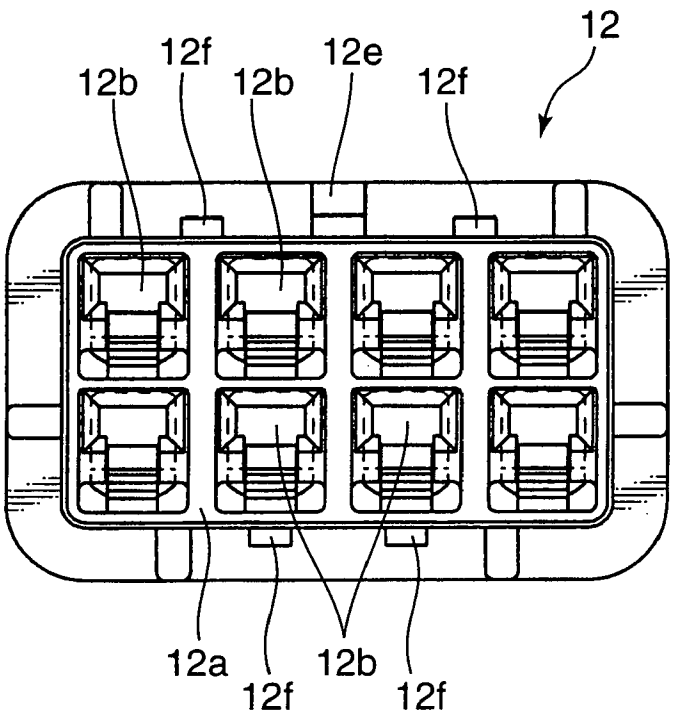
FIG. 2A is a front view showing a female housing of a female connector constituting the waterproof connector.

On the other hand, the female housing 12 of the female connector C1 is integrally formed by an insulating member such as a synthetic resin and includes terminal accommodating chambers 12*c* accommodating the female terminals 10 respectively, as shown in FIGS. 2A and 2B. Each terminal accommodating chamber 12*c* extends in an axial direction (forward and backward directions of the connector), and on the rear side (on the right side in FIG. 2B) thereof, there is formed a rubber stopper press-in hole 12*d* having a shape (for example, shape of a circular in cross section) to allow the rubber stopper 15 to be press-inserted thereinto. Further, the female housing 12 has a front wall 12*a*, which is formed with male terminal insertion holes 12*b* connected respectively to the terminal accommodating chambers 12*c* respectively. As will be described hereinafter, the male terminals 20 can be inserted respectively into the male terminal insertion holes 12*b* from the front side.

In each terminal accommodating chamber 12*c*, there is formed a lance 13 having a shape operable to lock a female terminal 10. Specifically, the lance 13 has a cantilevered crossbeam-like shape extending from a bottom surface of the terminal accommodating chamber 12*c* toward the front side (the left side in FIG. 2B), and has a terminal locking projection 13*a* projecting upward from the end portion of the lance 13. The lance 13 can be flexibly deformed in upward and downward directions to be shifted between a locking position where the terminal locking projection 13*a* is inserted into a through hole formed in a bottom wall of the female terminal 10 to lock the female terminal 10 (a position shown in FIG. 1) and a lock releasing position where the terminal locking projection 13*a* retreats downward from the locking position.

The female housing 12 has a ceiling wall which is provided with a connector connection locking projection 12*e* projecting upward. Each of the ceiling wall and the bottom wall is formed with a holder locking projection 12*f* projecting upward and downward at a front side of the connector connection locking projection 12*e*.

Figure 3B:
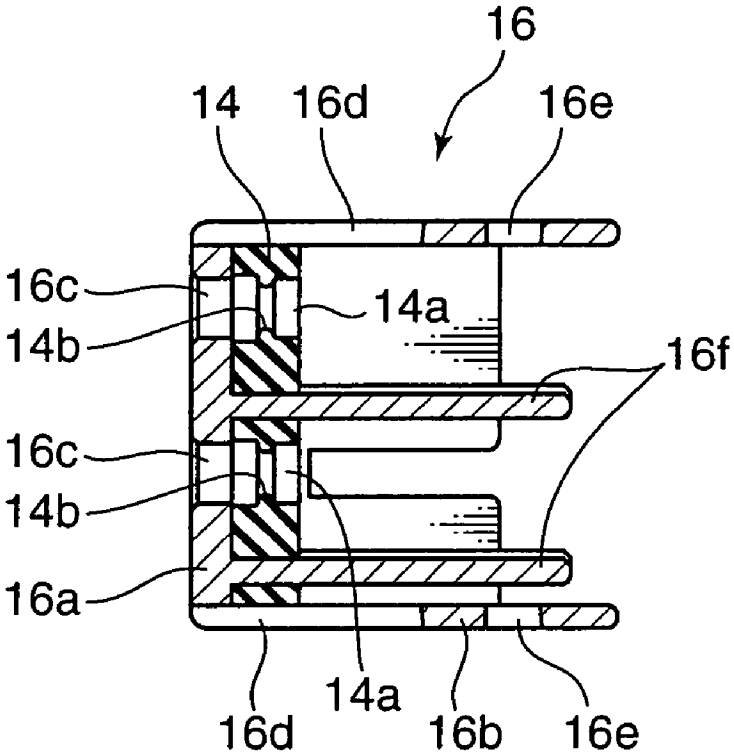
FIG. 3B is a side sectional view of the same.
Figure 3A:
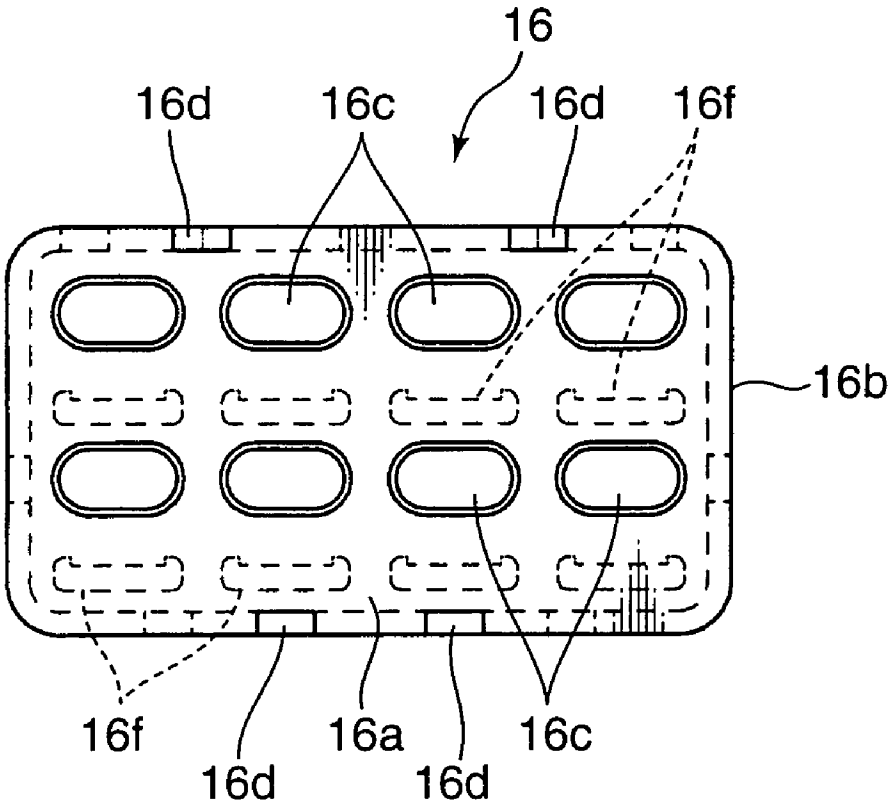
FIG. 3A is a front view showing a seal member holder of the female connector.

Further, as shown in FIGS. 3A and 3B, a sealing member holder 16 for retaining the waterproof female seal member 14 can be attached to the front side of the female housing 12.

The seal member holder 16 is also integrally formed by an insulating member such as a synthetic resin and has a cap-like shape integrally including a front side wall 16*a* having a shape operable to cover the front surface of the female housing 12 and a peripheral wall 16*b* extending from a periphery of the front side wall 16*a* to the rear side i.e. the side of the female housing 12.

The front side wall 16*a* is formed with projecting portion insertion holes 16*c* at positions corresponding to the male terminal insertion holes 12*b* respectively, into which the projecting portions 25 formed in the male housing 21 described hereinafter can be inserted respectively.

Figure 4A:
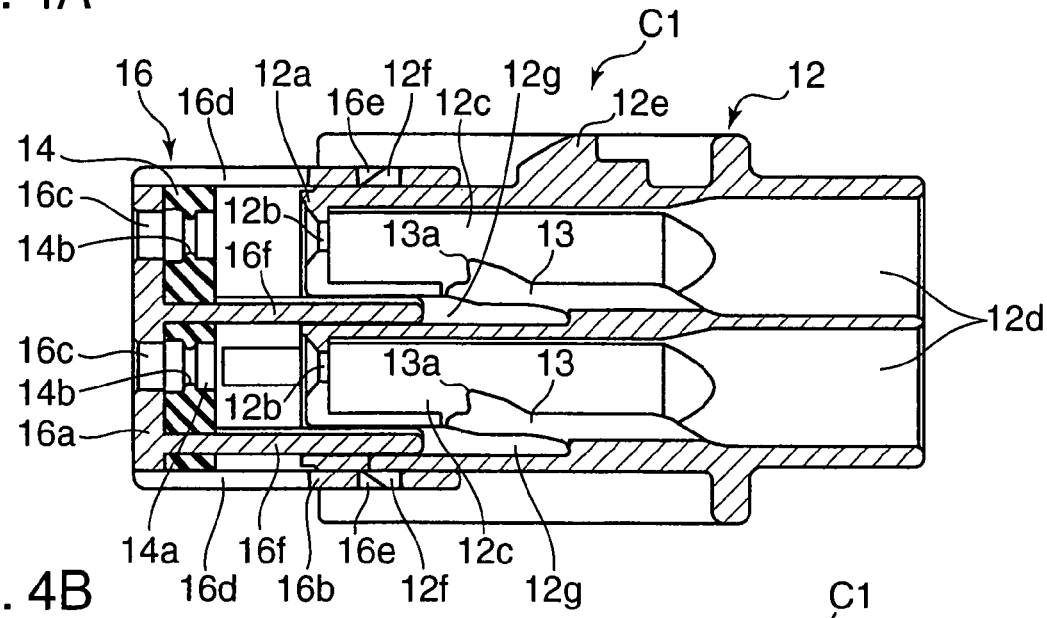
FIG. 4A is a side sectional view showing the state where the seal member holder of the female connector is positioned at a temporal locking position.

The peripheral wall 16*b* has a shape operable to fit at the outside of a front portion of the female housing 12, and is formed with elongate through holes 16*d* extending forward and backward and through holes 16*e* on the rear side of the elongate through holes 16*d* in each of an upper portion and a lower portion of the female housing 12. The elongate through holes 16*d* and the through holes 16*e* are formed at positions where the holder locking projection 12*f* of the female housing 12 can fit into either of the holes 16*e*, 16*f*. The seal member holder 16 has a temporal locking position where the holder locking projection 12*f* fits into the through hole 16*e* as shown in FIG. 4A respectively, and a complete locking position where the holder locking projection 12*f* fits into a rear end of the elongate through hole 16*d* and a rear end of the peripheral wall 16*b* comes in contact with the connector connection locking projection 12*e* (a position where the seal member holder 16 is completely attached to the female housing 12).

In other words, in the present embodiment, the holder locking projections 12*f* are used as both a temporal locking portion for retaining the seal member holder 16 at the temporal locking position and a complete locking portion for retaining the holder 16 at the complete locking position.

Figure 4B:
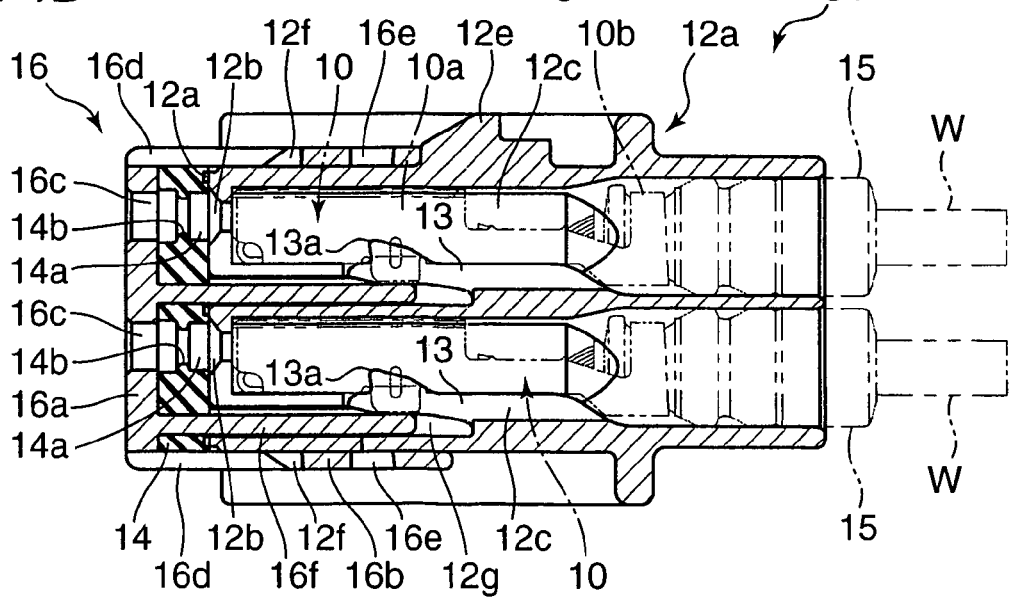
FIG. 4B is a side sectional view showing the state where the seal member holder is positioned at a complete locking position.

The female seal member 14 is formed out of an elastic member such as rubber or the like in the shape of a sheet and is fastened on a substantially whole back surface of the front side wall 16*a* of the seal member holder 16. The female seal member 14 has through holes 14*a* formed at positions corresponding to the male terminal insertion holes 12*b* and projection insertion holes 16*c* respectively. An inner surface of the through hole 14*a* has a close contact projecting portion 14*b* projecting inward in an entire circumference at an intermediate position in an axial direction of the through hole 14*a*. As shown in FIGS. 1 and 4B, the female seal member 14 comes in close contact with the front surface of the housing front wall 12*a* in the state where the seal member holder 16 is completely attached to the female housing 12 (in other words, in the state where the seal member holder 16 is retained at the complete locking position).

It should be noted that means for fastening the female seal member 14 to adhere to the seal member holder 16 is not especially limited. Means of press fitting, bonding or the like may be used, and the female seal member 14 may be integrally formed on the seal member holder 16 by double-molding. Alternatively, the female seal member 14 may be fixedly attached on the front side of the female housing 12.

Further, in the female connector C1 of the present embodiment, the seal member holder 16 has a function of doubly-locking of the female terminal 10 to the female housing 12.

Specifically, the seal member holder 16 has a plurality of double-locking pieces 16*f* corresponding to the terminal accommodating chambers 12*c* respectively and penetrating from the rear side of the front side wall 16*a* of the seal member holder 16 toward the rear side in an axial direction (in other words, toward the side of the female housing 12) through the female seal member 14. On the other hand, the female housing 12 is provided with insertion slots 12*g* each having a shape to allow the double-locking pieces 16*f* to be inserted thereinto respectively from the front surface side. Each insertion slot 12*g* reaches a position immediately under each of the lances 13. Then, the double-locking pieces 16*f* are inserted to the respective insertion slots 12*g*, so that the seal member holder 16 reaches the complete locking position, where each double-locking piece 16*f* penetrates under each of the lances 13 to hold the lance 13 at the locking position (in other words, at the position where the terminal locking projection 13*a* of each lance 13 fits into a through hole of the female terminal 10).

2) Specific Configuration of the Male Connector C2

Each male terminal 20 of the male connector C2 integrally includes a tab 20*a* and a barrel portion 20*b* formed on the rear side of the tab 20*a*. The tab 20*a* has an extremity end formed as a male type electric connection portion 20*c* operable to fit into the electric connection portion 10*a* of the female terminal 10. The barrel portion 20*b* is bent to be crimped onto an end of an electric wire W. On immediate rear side thereof, a rubber stopper 25 for waterproofing is mounted.

On the other hand, a male housing of the male connector C2 is formed by molding an insulating material such as a synthetic resin like the female housing 12, and for molding it and taking the same out of die, divided into a front section 21 and a rear section 22. Further, a male seal member 24 is placed therebetween.

Figure 5B:
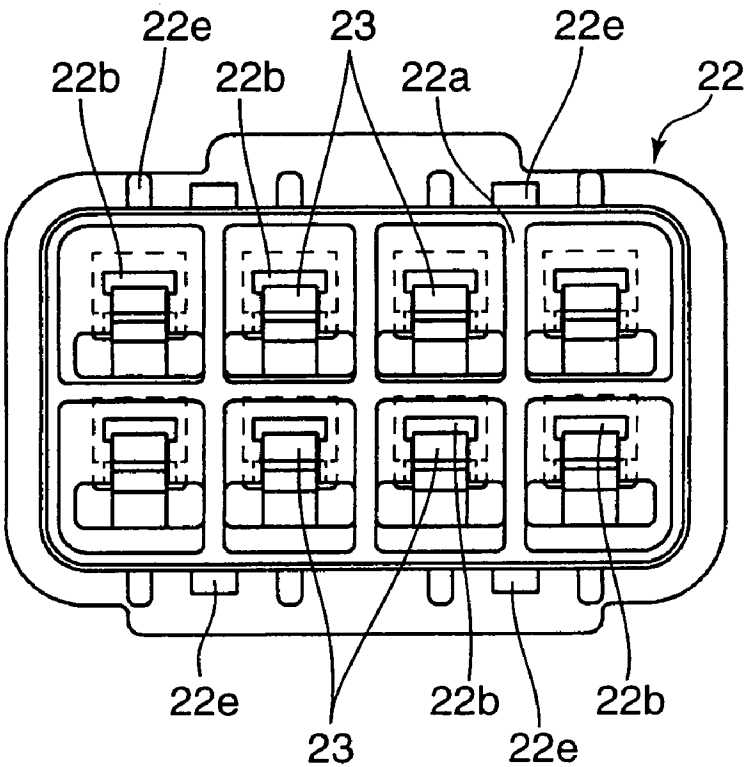
FIG. 5B is a front view showing the rear section.
Figure 5A:
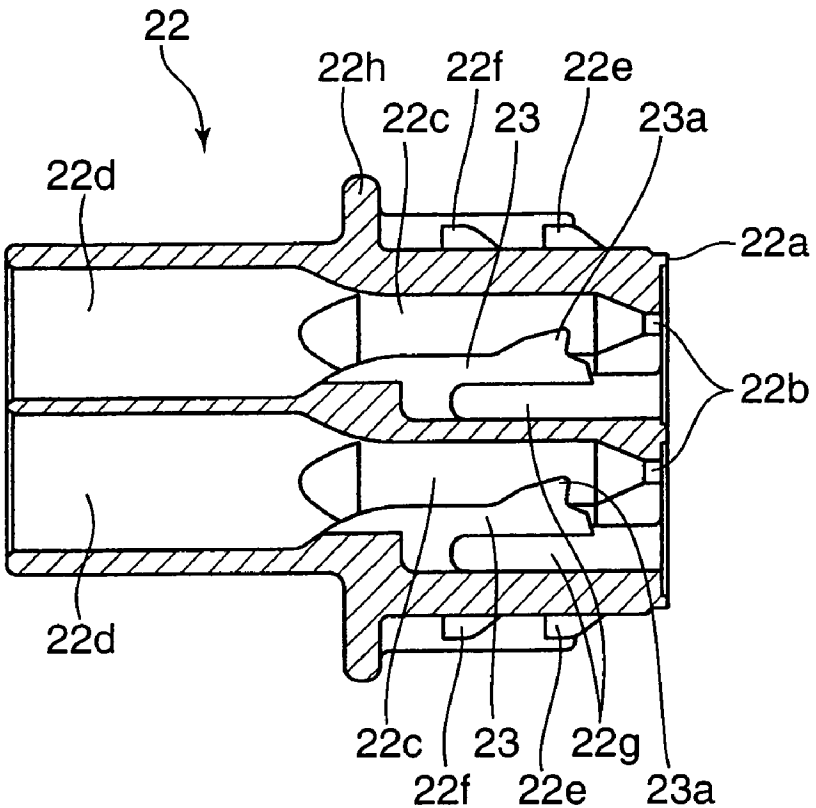
FIG. 5A is a side sectional view showing a rear section of a female housing of a male connector constituting the waterproof connector.
Figure 6B:
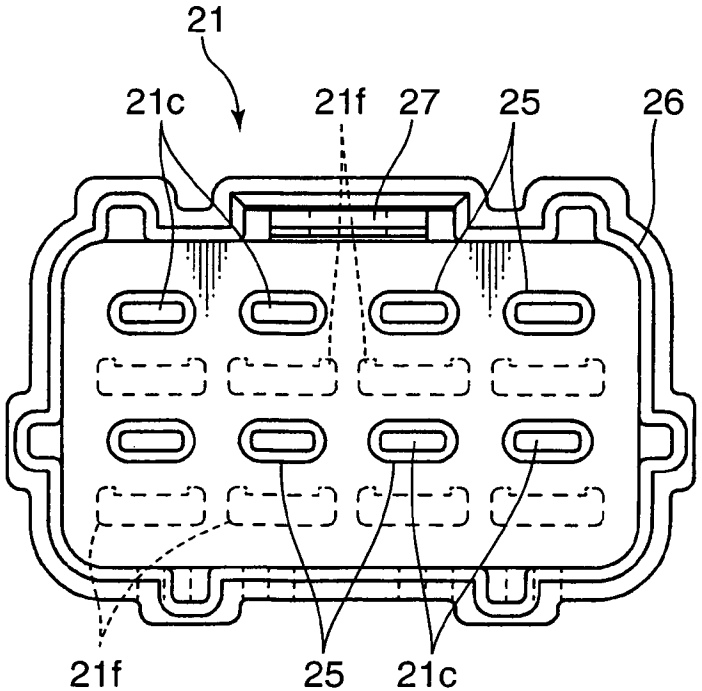
FIG. 6B is a front view of the same.
Figure 6A:
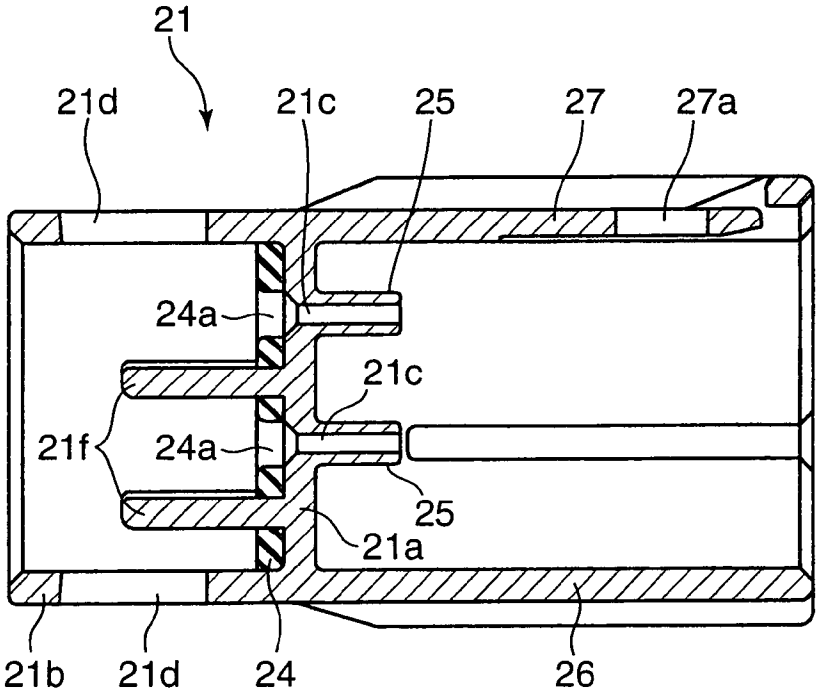
FIG. 6A is a side sectional view showing a front section of the male housing.

As shown in FIGS. 5A and 5B, the rear section 22 has terminal accommodating chambers 22*c* for accommodating the male terminals 20 respectively. Each terminal accommodating chamber 22*c* extends in an axial direction (forward and backward direction of the connector), and on the rear side thereof (on the left side in FIG. 5A), there are formed rubber stopper press-in holes 22*d* each having a shape (ex. a shape with a circular cross section) to allow the rubber stopper 25 to be inserted without a gap. The rear section 22 has a front wall, which are formed with male terminal leading-out holes 22*b* for respectively leading out tabs of the male terminals 20 each accommodated in the terminal accommodating chamber 22*c* from inside of the housing to the outside. Through each male terminal leading-out hole 22*b*, the tab 20*a* of each male terminal 20 projects forward beyond the front surface 22*a* of the rear section 22.

In each of the terminal accommodating chambers 22*c*, there is formed a lance 23 for locking the male terminal 20. The lance 23, like the lance 13 of the female housing 12, has a cantilevered beam-like shape extending from the bottom surface of the terminal accommodating chamber 22*c* toward the front side (the right side in FIG. 5A), and has an end portion from which a terminal locking projection 23*a* projects upward. The lance 23 is flexible in upward and downward directions to shift the terminal locking projection 23*a* between a locking position (the position shown in FIG. 1) for locking the male terminal 20 in a through hole formed in a bottom wall of the male terminal 20 and a lock-releasing position for retreating downward from the locking position.

The terminal accommodating chambers 22*c* and the lances 23 are molded in a die assembly and thereafter the die is pulled out forward, so that there are formed large openings in the front surface 22*a* of the rear section 22 for the terminal accommodating chambers, as shown in FIG. 5B.

The rear section 22 has a ceiling wall, which are formed with a temporal locking projection 22*e* and a complete locking projection 22*f* consecutively from the front side, and a collar portion 22*h* is formed on further rear side.

On the other hand, the front section 21 integrally includes a main body wall 21*a* having a shape operable to cover the front surface 22*a* of the rear section 22, a peripheral wall 21*b* extending from a periphery of the main body wall 21*a* i.e. toward the rear section 22, and a hood 26 extending in the opposite direction to the peripheral wall 21*b*. In other words, the front section 21 has a shape having the peripheral wall 21*b* and the hood 26 at the front and rear sides respectively, and is internally provided with the main body wall 21*a*.

The main body wall 21*a* has male terminal through holes 21*c* and the projecting portions 25 at positions corresponding to the male terminal leading-out holes 22*b* respectively. Each male terminal through hole 21*c* has a diameter to allow a tab 20*a* of the male terminal 20 to be inserted thereinto without almost no gap. Each projecting portion 25 projects forward from the main body wall 21*a* and has a cylinder-like shape operable to cover a portion where the tab 20*a* is inserted into the male terminal through hole 21*c* (in other words, a portion behind the electric connection portion 20*c*), and has an outer diameter which allows the projecting portion 25 to come in close contact with the projecting portion 14*b* of the through hole 14*a* in the female seal member 14 of the female connector C1 in an entire circumference.

Figure 7A:
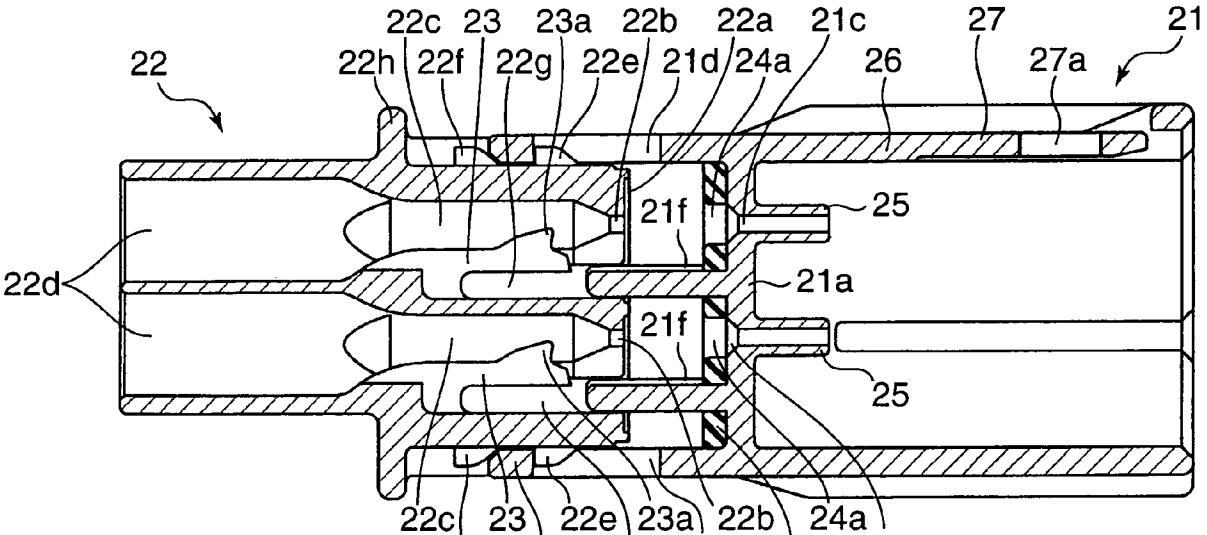
FIG. 7A is a side sectional view showing the state where the front section of the male connector is positioned at a temporal locking position.
Figure 7B:
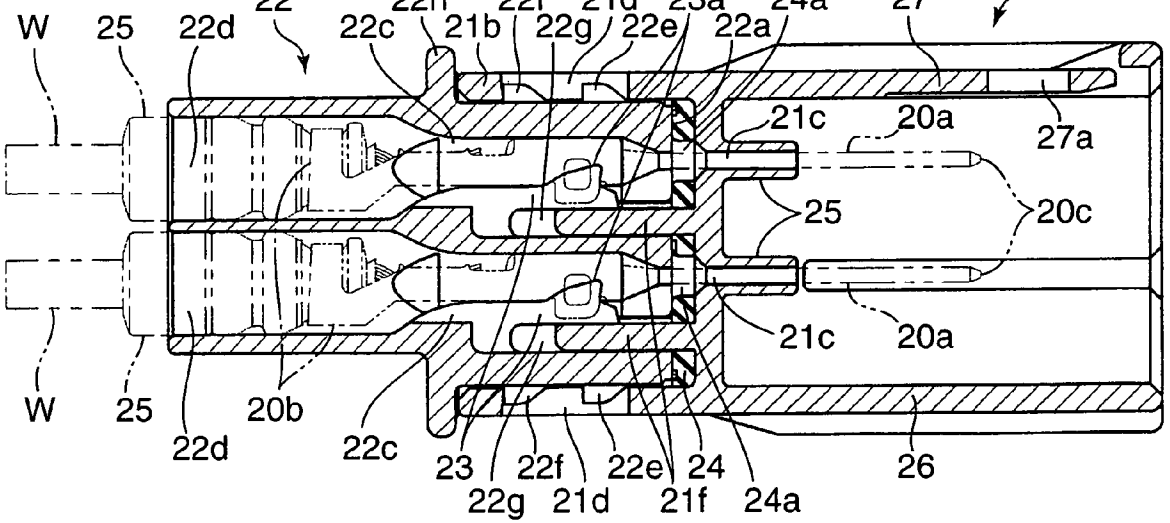
FIG. 7B is a side sectional view showing the state where the front section is positioned at a complete locking position.

The peripheral wall 21*b* has a shape operable to fit at the outside of the front portion of the rear section 22, and is formed with elongate through holes 21*d* each extending in forward and backward directions in upper and lower portions. The elongate through holes 21*d* are formed at positions where the temporal locking projections 22*e* and the complete locking projections 22*f* of the rear section 22 can fit thereinto. The rear section 22 has a temporal locking position where only the temporal locking projections 22*e* fit into the respective elongate through holes 21*d* and a rear end of the peripheral wall 21*b* comes in contact with a front side surface of the complete locking projections 22*f* as shown in FIG. 7A, and a complete locking position where a rear end of the peripheral wall 21*b* fits into the elongate through hole 21*d* in addition to the temporal locking projection 22*e* to come in contact with the collar portion 22*h* as shown in FIG. 7B (in other words, the position where the front section 21 is attached to the rear section 22 completely).

The male seal member 24 is formed out of an elastic material for sealing such as rubber or the like formed in the shape of a sheet and is fastened on substantially whole area of the rear side of the main body wall 21*a* of the front section 21. The male seal member 24 has through holes 24*a* formed at respective positions corresponding to the male terminal leading-out holes 22*b* and male terminal through holes 21*c*. Each through hole 24*a* has a shape a size larger than the tab 20*a*. The male seal member 24 comes in close contact with the front surface 22*a* of the rear section 22 when, as shown in FIG. 1 and FIG. 7B, the front section 21 is completely attached to the rear section 22 (in other words, retained at the complete locking position).

In the present embodiment, means for fastening the male seal member 24 to the front section 21 is not especially limited. Means of press fitting, bonding or the like may be used, and the female seal member 14 may be integrally formed on the front section 21 by double-molding. Alternatively, the male seal member 24 may be fastened on the side of the front surface 22*a* of the rear section 22. In summary, it is fine as long as the male seal member 24 is placed between the sections 21, 22 when the rear section 22 and the front section 21 are combined to guarantee respective terminal waterproof function which the female connector C1 has.

On the other hand, the hood 26 has a cylinder-like shape operable to cover the tabs 20*a* of the male terminals 20. The hood 26 is formed with a flexible locking piece 27, which has an end portion formed with a locking hole 27*a*. When the connectors C1, C2 are connected each other as will be described hereinafter, the connector connection locking projection 12*e* of the female connector C1 fits into the locking hole 27*a* to lock the connection of the connectors C1, C2.

The male connector C2 according to the present embodiment has a further function of double locking of the male terminals 20 by using the separated structure of the male housing.

Specifically, the front section 21 has a plurality of double-locking pieces 21*f* corresponding to the terminal accommodating chambers 22*c*. Each double-locking pieces 21*f* projects from the rear side of the main body wall 21*a* backward in an axial direction (in other words, in a direction toward the rear section 22), penetrating the male seal member 24. On the other hand, the rear section 22 is provided with insertion slots 12*g* each having a shape to allow the double-locking piece 21*f* to be inserted thereinto from the front side. The insertion slot 22*g* reaches a position immediately under the insertion slot 22*g*. Then, the front section 21 reaches the complete locking position while the double-locking pieces 21*f* are inserted to the respective insertion slots 22*g*. Thereby, each double-locking piece 21*f* penetrates under each lance 23 to hold the lance 23 at the locking position (in other words, at the position where the terminal locking projection 23*a* of each lance 23 is fit into a through hole of the male terminal 20.

3) Assembling Procedures and Action of Each of the Connectors C1, C2

Assembling procedures and action of each of the connectors C1, C2 are described herebelow.

First, in the female connector C1, the seal member holder 16 is held in the female housing 12 at the temporal locking position, as shown in FIG. 4A. In other words, the peripheral wall 16*b* of the seal member holder 16 fits at the outside of the front portion of the female housing 12 while each of the double-locking pieces 16*f* of the seal member holder 16 is inserted into the insertion slot 12*g* from the front side, and the holder locking projection 12*f* of the female housing 12 fits into the through hole 16*e* of the seal member holder 16. Then, each female terminal 10 crimped onto the terminal end of the electric wire W is inserted into each of the terminal accommodating chambers 12*c* from the rear side (in other words, through the rubber stopper press-in hole 12*d*).

At this time, the lance 13 is not retained by the double-locking piece 16*f* of the seal member holder 16. Accordingly, the lance 13 is flexibly deformed so as to be temporarily retracted while insertion of the female terminal 10 proceeds. When the insertion is completed, the lance 13 is elastically restored and the terminal locking projection 13*a* fits into the through hole formed in the bottom wall of the female terminal 10, thus locking the female terminal 10 on the side of the female housing 12. Further, the rubber stopper 15 into which an electric wire W is inserted is press-inserted into the rubber stopper press-in hole 12*d* to prevent immersion of water into the female housing 12 through the rubber stopper press-in hole 12*d*.

The seal member holder 16 is further pressed toward the rear side of the female housing 12 from the temporal locking position shown in FIG. 4A to reach the complete locking position (in other words, the position where the holder locking projection 12*f* fits into the rear end portion of the elongate through hole 16*d*) shown in FIG. 4B. Thereby, the female seal member 14 retained by the seal member holder 16 comes in close contact with the front surface of the housing front wall 12*a*, and each double-locking piece 16*f* of the seal member holder 16 penetrates under the lance 13 to retain the lance 13 at the locking position. This achieves the double locking of each of the female terminals 10, and assembling of the female connector C1 is completed. If any female terminal 10 is not sufficiently inserted to reach the proper position at this point, the terminal 10 prevents the shift of a corresponding lance 13 to the locking position, thus precluding pressing the seal member holder 16 up to the complete locking position. This enables detecting the half-inserted state of the female terminal 10 in advance.

On the other hand, in the male connector C2, the front section 21 is retained by the rear section 22 of the male housing as shown in FIG. 7A at the temporal locking position. In other words, the peripheral wall 21*b* of the front section 21 fits at the outside of the front portion of the rear section 22 while the double-locking piece 21*f* of the front section 21 is inserted into the insertion slot 22*g* from the side of the front surface 22*a*, and the temporal locking projection 22*e* of the rear section 22 fits into the elongate through hole 21*e*. Then, the male terminals 20 crimped onto respective terminal ends of the electric wires W in advance are inserted to the respective terminal accommodating chambers 22*c* from the rear side (in other words, through the rubber stopper pressing-in hole 22*d*).

At this time, the lance 23 is not retained by the double-locking piece 21*f* of the front section 21. Accordingly, the lance 23 is flexibly deformed to be retracted once to the lock-releasing position while the male terminal 20 is inserted. When the insertion is completed, the lance 23 is elastically restored in such a manner that the terminal locking projection 23*a* fits into the through hole formed in the bottom wall of the male terminal 20 to primarily lock the male terminal 20 on the side of the rear section 22. Further, the rubber stopper 25 to which an electric wire W is inserted is press-inserted into the rubber stopper pressing-in hole 22*d* to prevent immersion of water into the male housing through the rubber stopper pressing-in hole 22*d*.

The front section 22 is further pressed toward the rear section 21 from the temporal locking position shown in FIG. 7A to reach the complete locking position (in other words, the position where the complete locking projection 22*f* fits into the rear end of the elongate through hole 21*d*) shown in FIG. 7B. Thereby, the male seal member 24 fastened to the front section 22 comes in close contact with the front surface 22*a* of the rear section 22, and each double-locking piece 21*f* of the front section 21 penetrates under the lance 23 to retain the lance 23 at the locking position. This achieves the double locking of the male terminal 20, and assembling of the male connector C2 is completed. If any male terminal 20 is not sufficiently inserted to reach the proper position, the terminal 20 prevents shift of a corresponding lance 23 to the locking position, thus precluding pressing the front section 21 up to the complete locking position. This enables detecting the half-inserted state of the male terminal 20 in advance.

The connectors C1, C2 which are assembled in such manner as described above are connected with each other to make respective pairs of terminals 10, 20 connected with each other waterproof individually and effectively. Specifically, as shown in FIG. 1, the electric connection portion 20*c* of the tab 20*a* of each of the male terminals 20 fits into the electric connection portion 10*a* of the female terminal 10 through the male terminal insertion hole 12*b* of the female housing 12 to make conduction between terminals 10, 20, while the projecting portion 25 formed on each of the male terminals 20 fits into the projecting portion insertion hole 16*d* of the seal member holder 16 to make close contact with a whole circumference of the seal projecting portion 14*b* in the through hole 14*a* in the female seal member 14, thus allowing the female seal member 14 to prevent immersion of water into female housing 12 through the male terminal insertion hole 12*b*.

Further, also in the male connector C2, even though the male housing is divided into the front section 21 and the rear section 22 for molding, each male terminal 20 is individually guaranteed with waterproofing by the seal member pressed between the portions 21, 22. Furthermore, by utilizing the separated structure, the double-locking of the male terminal 20 can be pursued with a simple structure.

Figure 8A:
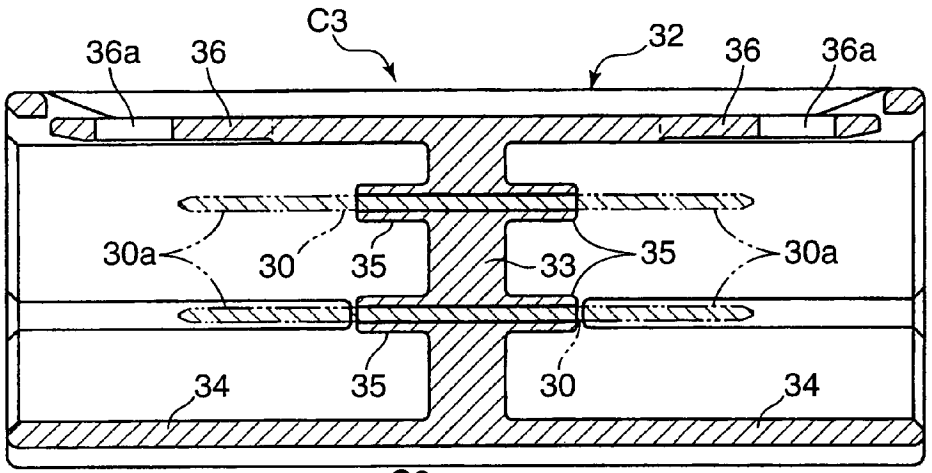
FIG. 8A is a side sectional view showing an example of a relay connector for connecting the female connector with another female connector.

Next, another embodiment of the present invention will be described with reference to FIG. 8.

In the present embodiment, two waterproof female connectors C1 each having a structure which is same as that of the structure shown in FIG. 1 to FIG. 4 are provided respectively at ends of wires, and these waterproof female connectors are connected with each other via the relay connector C3.

The relay connector C3 is formed by integrally molding a plurality of relay male terminals 30 corresponding to the respective female terminals 10 of the female connector C1 with an insulating housing 32. Each relay terminal 30 has a pin-like shape having opposite ends as electric connection portions 30*a*, and an intermediate portion, which is retained by the insulating housing 32.

The insulating housing 32 integrally has a main body wall 33 extending in a direction perpendicular to its axial direction and a cylinder-like hood extending toward opposite sides in an axial direction from a periphery of the main body wall 33. The male terminal 30 has an intermediate portion, which is retained by the main body wall 33 in a water-close state and in the state where each relay terminal 30 penetrates through the main body wall 33 in its thickness direction, and both electric connection portions 30*a* of each relay terminal 30 are covered with the hood 34 from the outer side. Further, a locking flexible piece 36 is formed in each hood 34, being formed with a locking hole 36*a* into which a connector connection locking projection 12*e* of each female connector C1 fit.

Instead of integrally molding the relay terminals 30 and the insulating housing 32, each relay terminal 30 may be press-inserted into a through hole formed in advance in a main body wall 33 of the insulating housing 32. In summary, it is fine as long as the relay terminals 30 are retained in close contact with the side of the insulating housing 32 to keep waterproofing function for respective terminals on the side of the female connector C1.

As a feature of the relay connector C3, the main body wall 33 has opposite side surfaces, which are formed with projecting portions 35 of, respectively. These projecting portions 35 are provided on respective male terminals 30 like the projecting portions 25 of the male connector C2 shown in FIG. 1. Each of the projecting portion 35 is formed to be a cylinder-like shape operable to cover a portion of the male terminal 30 on the rear side (on the side of the main body wall 33) of the electric connection portion 30*a*, and has an outer diameter such that the projecting portion 35 is operable to come in close contact with a whole circumference of the seal projecting portion 34*b* of each through hole 34*a* in the seal member 34 of the female connector C1. Further, in the example shown in the figure, as a waterproofing means for a rear portion of the female housing 12, there is used a plate-like seal member 17 into which an electric wire W is inserted in a close-contact state, instead of the seal rubber stopper 15 shown in FIG. 1. The seal member 17 is press-inserted into a rear chamber of the female housing 12, and a cover 18 is attached onto the outer side of the seal member 17.

Figure 8B:
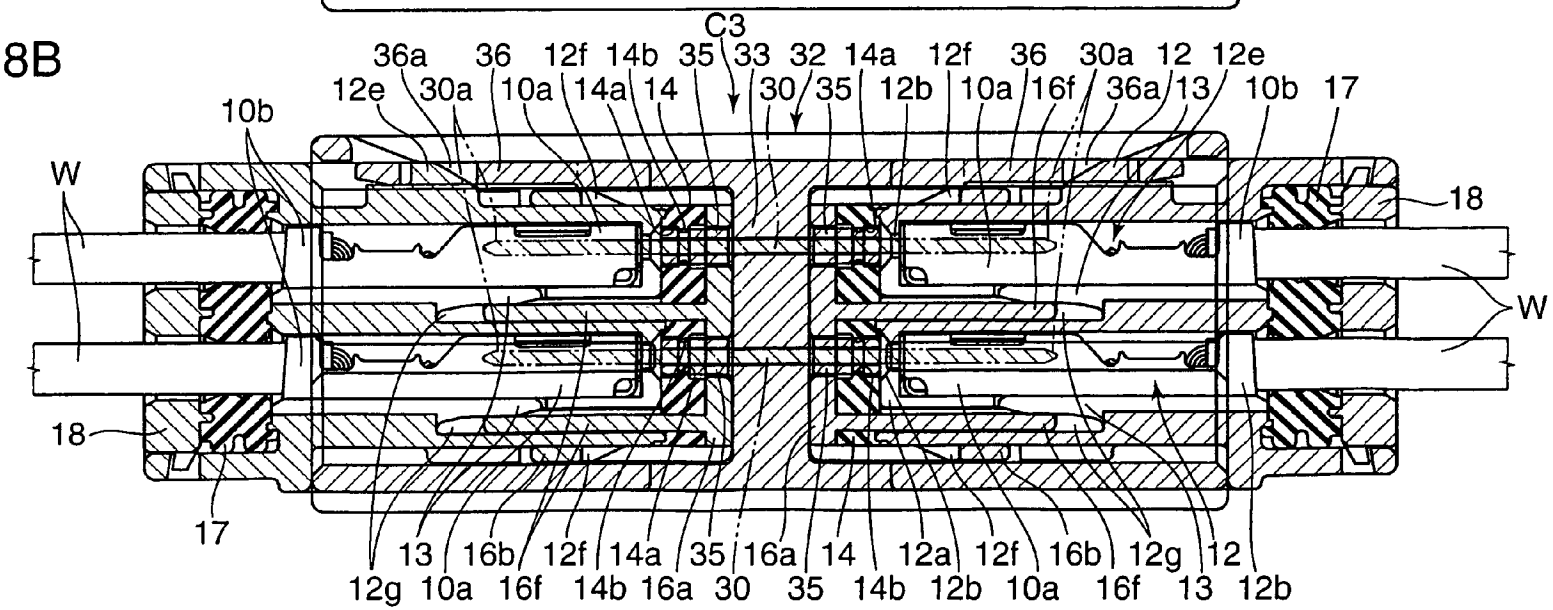
FIG. 8B is a side sectional view showing the state where the female connectors are connected with each other with the relay connector.
Figure 9:
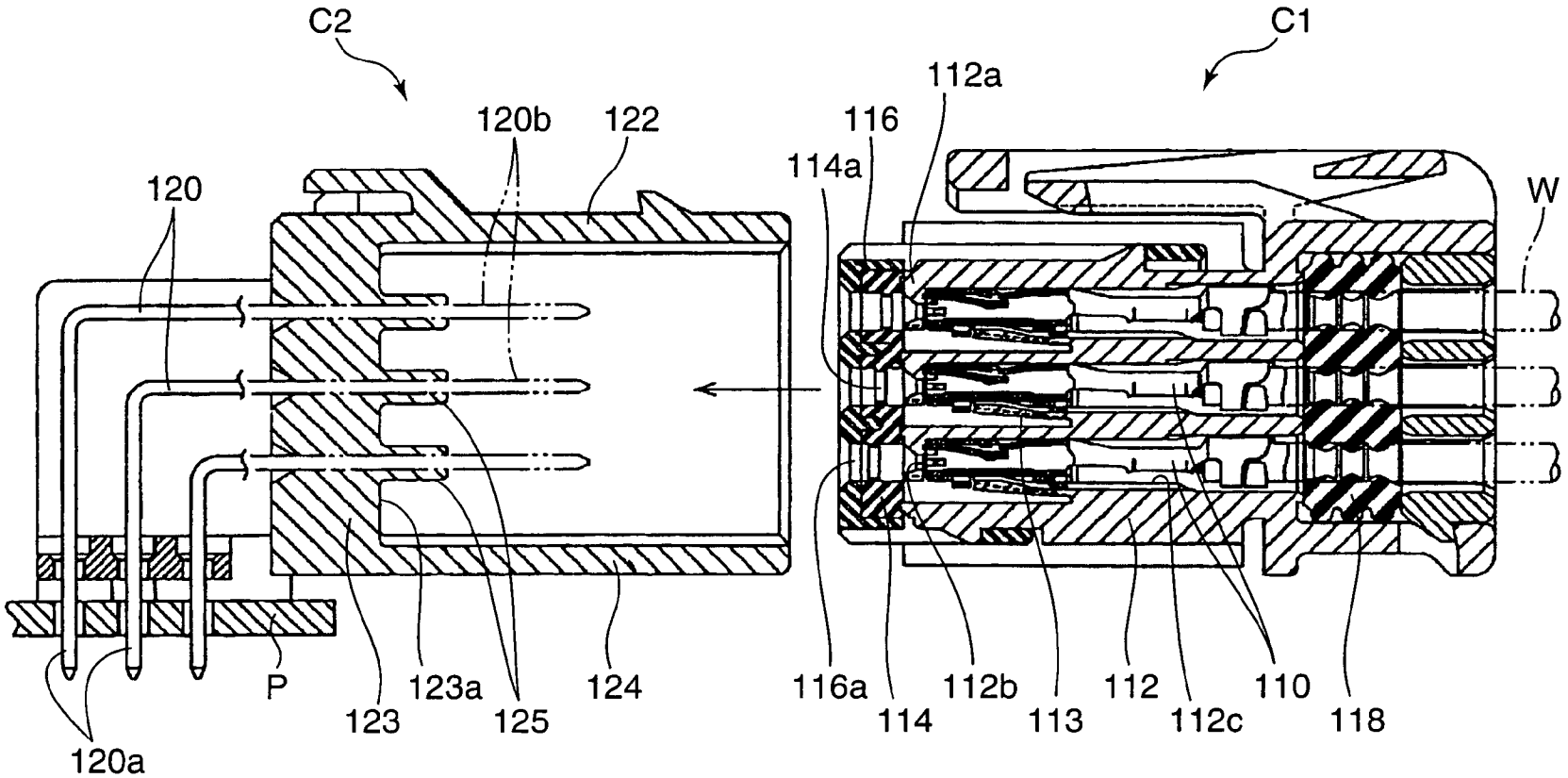
FIG. 9 is a side sectional view showing an example of a conventional waterproof connector.

In the waterproof connector as described above, by engaging both electric connection portions 30*a* of each relay terminal 30 in the relay connector C3 and the electric connection portion 10*a* of the female terminal 10 in each female connector C1 fit with each other as shown in FIG. 8B, thus making electrical connection between the female terminals 10 of the female connectors C1 through the relay terminal 30. At the same time, the projecting portions 35 on both sides of the main body wall 33 in the relay connector C3 comes in close contact with the seal projecting portion 34*b* of the seal member 34 in each female connector C1 to make it possible to prevent each female terminal 10 individually from the immersion of water into the female housing 12 through the male terminal insertion hole 12*b* of the female housing 12 in both female connectors C1. Thus, like the previous embodiment described above, it becomes possible to make electrical connection between the female terminals 10 of the respective female connectors C1 via the relay terminal 30 while securing the individual waterproofing function of each female connector C1.

Other than the above, the present invention can take the following embodiment.

While, in the male connector C2 shown in FIG. 1 or the like, the double-locking piece 21*f* retains the lance 23 at the locking position to pursue the double locking of the male terminal 20 the double locking portion may lock the male terminal 20 directly (in other words, perform the double locking) at another position than the locking position of the male terminal 20 by the lance 23, for example. Further, the waterproof male connector according to the present invention does not necessarily need the double-locking function. The mating waterproof female connector also does not.

A specific shape of the male housing can be set preferably. For example, the peripheral wall 21*b* may be omitted while the double-locking piece 21*f* being locked on the side of the rear section 22. The hood 26 may be omitted. In the case of using the relay connector C3, female connectors C1 which are to be connected with each other via the relay connector C3 may have the identical shape and structure, or may have different shape and structure. In the former case, mass productivity of the waterproof connectors as a whole is improved.

As described above, according to the waterproof male connector and the waterproof connector having the waterproof male connector of the present invention, since the male housing of the waterproof male connector is divided into a front section having the projecting portions and a rear section having the terminal accommodating chambers and terminal locking portions, the projecting portions, the terminal accommodating chambers and the terminal locking portions can be formed respectively without any difficulties. Further, since the both sections are combined while holding the male seal member therebetween, the male connector also can retain the individual waterproofing effect by the close contact between the projecting portions and the female seal member of the mating waterproof female connector even though the male housing is divided.

Further, if the front section has double-locking portion to be inserted to the rear section from the front side when being inserted to the rear section, and the double-locking portion pursues the double locking of the male terminal to the side of the rear section in the state where the front section is completely connected with the rear section, it is possible to give the male housing a function of the double locking of the male terminal with a simple structure utilizing the division of the male housing.

If the rear section of the male housing includes a temporal locking portion for locking the front section at a temporal locking position where the double locking portion of the front section is inserted to the rear section but does not pursue the double locking of the male terminal, and a complete locking portion for locking the front section at a complete locking position where the front section is completely connected with the rear section, it is possible to place the male seal member between the front section and the rear section and to accomplish the double locking of each of the male terminals with a simple operation of inserting the male terminal into the terminal accommodating chamber of the rear section to lock the same with the terminal locking portion in the state where the front section is temporarily locked on the rear section at the temporal locking position and thereafter moving the front section from the temporal locking position to the complete locking position.

Concerning means for pursuing such double-locking of the male terminal, if the terminal locking portion of the rear section of the male housing is a lance which can be shifted between the locking position of locking the male terminal and the lock-releasing position of releasing the locking of the male terminal, and the double locking portion of the seal member holder retains the lance at the locking position to doubly lock the male terminal, the double locking of the male terminal can be made with a simple configuration of retaining the lance including the terminal locking portion at the locking position.

Concerning a specific shape of the male housing, if the front section has a shape integrally including a front side wall covering a front surface of the rear section and having the projecting portion, a peripheral wall extending from a periphery of the main body wall toward the rear section to be engaged with the outer surface of the female housing, and a hood extending from a periphery of the main body wall in opposite direction with respect to the peripheral wall and covering the electric connection portion of the male terminal, and the seal member is held between the back surface of the main body wall and the front surface of the rear section, the hood can effectively protect the male terminal while the front section as a whole has a simple cylindrical structure. On the other hand, the peripheral wall on the opposite side of the hood is engaged with the outer surface of the rear section to combine the front section and the rear section in a stable state.

According to the waterproof relay connector according to the present invention and the waterproof connector utilizing the waterproof relay connector, the electric connection portions on opposite ends of each relay terminal of the waterproof relay connector are inserted into the respective electric connection portions of the female terminals of each female connector to make electrical connection between the female terminals of the female connectors through the relay terminals. At the same time, each of the projecting portions of the insulating housing retaining the relay terminals in a close contact state comes in close contact with an inner surface of the through hole of the female seal member in each female connector, which enables each female connector to perform sufficient waterproofing function.

Further, if the female connectors connected with each other via the relay connector have the identical shape and structure to each other, mass productivity of the waterproof connector can be improved.

The invention claimed is:

1. A waterproof male connector which is to be connected with a waterproof female connector, the female connector being provided with a plurality of female terminals held by a female housing and a female seal member provided in front of the female terminals and formed with through-holes respectively corresponding to the female terminals, the waterproof male connector comprising:

a plurality of male terminals each fastened to an end of an electric wire and having an electric connection portion operable to fit into a corresponding female terminal;

a male housing including terminal accommodating chambers for individually accommodating the respective male terminals and terminal locking portions for locking the male terminals in the respective terminal accommodating chambers, and holding the male terminals so that the respective electric connection portions of the male terminals project forward, wherein the male housing includes on a front thereof projecting portions each having a shape operable to cover a rear part of the electric connection portion and to come into close contact with an inner surface of the through-hole of the female seal member when the electric connection portion is placed in the female terminal to thereby prevent immersion of water into the female housing; and the male housing is divided into a front section including the projecting portions and a rear section including the terminal accommodating chambers and the terminal locking portions, the front section and the rear section being combined in a state of holding a male seal member having through-holes for passing the male terminals respectively against each other.

2. The waterproof male connector according to claim 1, wherein the front section of the male housing has a cylinder-like shape, and integrally includes:

a main body wall having a shape covering the front surface of the rear section and formed with the projecting portions;

a peripheral wall extending from the periphery of the main body wall toward the rear side of the male housing to be engaged with an outer peripheral surface of the rear section; and a hood extending from the periphery of the main body wall in the direction opposite to the peripheral wall to cover the electric connection portions of the male terminals, and the male seal member is held between a rear surface of the main body wall and the front surface of the rear section.

3. The waterproof male connector according to claim 1, wherein the front section includes double-locking portions insertable into the rear section from its front surface in the process of combining the front section with the rear section, the double-locking portions operable to lock the male terminals to the rear section in the state where the front section is completely combined with the rear section.

4. The waterproof male connector according to claim 3, wherein the rear section of the male housing includes:

a temporal locking portion for locking the front section at a temporal locking position where the double-locking portions of the front section comes into the rear section but does not lock the male terminals; and a complete locking portion for locking the front section at a complete locking position where the front section is completely combined with the rear section.

5. The waterproof male connector according to claim 3, wherein:

each of the terminal locking portions of the rear section of the male housing includes a lance which is shiftable between a locking position of locking the male terminal and a releasing position of releasing the locking of the female terminal; and the double-locking portion of the front section holds the lance at the locking position to pursue the double locking of the female terminals.

6. A waterproof connector comprising:

the waterproof male connector according to claim 1; and the waterproof female connector connected to the waterproof male connector, wherein the waterproof female connector includes:

the plurality of female terminals into which the electric connection portions of the male terminals fit respectively;

the female housing holding the female terminals and having male terminal insertion holes in front of the female terminals for passing the male terminals to fit into the female terminals respectively; and the female seal member in close contact with the front surface of the female housing, the female seal member having the through holes formed at positions corresponding to the respective male terminal insertion holes, and the inner surface of each through hole of the female side seal member coming into close contact with the outer peripheral surface of each projection of the waterproof male connector to thereby prevent immersion of water from the male terminal insertion hole into the female housing.

* * * * *